US007203989B2

(12) United States Patent
McLain

(10) Patent No.: US 7,203,989 B2
(45) Date of Patent: Apr. 17, 2007

(54) BUFFING BALL MADE OF FOAM MATERIAL

(75) Inventor: Scott S. McLain, Mukwonago, WI (US)

(73) Assignee: Lake Country Manufacturing, Inc., Hartland, WI (US)

( * ) Notice: Subject to any disclaimer, the term of this patent is extended or adjusted under 35 U.S.C. 154(b) by 222 days.

(21) Appl. No.: 10/927,208

(22) Filed: Aug. 26, 2004

(65) Prior Publication Data

US 2005/0120500 A1 Jun. 9, 2005

Related U.S. Application Data

(60) Provisional application No. 60/526,680, filed on Dec. 3, 2003.

(51) Int. Cl.
*A47L 13/16* (2006.01)
*B60S 3/06* (2006.01)
*B24D 11/00* (2006.01)

(52) U.S. Cl. ..... 15/244.1; 15/28; 15/97.1; 15/230; 15/230.17; 451/527

(58) Field of Classification Search ..... 15/230, 15/230.13, 230.14, 230.16, 230.17, 230.19, 15/28, 97.1, 97.3, 101, 244.1, 244.4; 451/536, 451/527, 528

See application file for complete search history.

(56) References Cited

U.S. PATENT DOCUMENTS 1,819,800 A * 8/1931 Turner ..... 15/230.19
2,004,623 A 6/1935 Yohe
2,744,281 A * 5/1956 Zinggeler ..... 15/244.1
3,020,139 A * 2/1962 Camp et al. ..... 51/295
3,026,552 A * 3/1962 Price ..... 15/97.1
3,204,277 A * 9/1965 Visman et al. ..... 15/244.1
4,177,611 A * 12/1979 Carr-Rollett ..... 451/508
4,199,835 A * 4/1980 Heyer et al. ..... 15/229.11
5,027,468 A 7/1991 Leventhal et al.
D353,940 S 1/1995 Joyner et al.
5,938,515 A 8/1999 McLain et al.
6,044,512 A * 4/2000 Hornby et al. ..... 15/97.1

OTHER PUBLICATIONS www.flitz.com/polishing_ball.htm ("The Flitz website"), made public on Nov. 22, 2001, see attached internet archive on p. 3.* 2001 Flitz Polishing & Buffing Ball description and instruction information.

* cited by examiner

*Primary Examiner*—Gladys J P Corcoran
*Assistant Examiner*—Laura C Guidotti
(74) *Attorney, Agent, or Firm*—Andrus, Sceales, Starke & Sawall, LLP

(57) ABSTRACT

A buffing and polishing ball made of a compressible polymeric foam material is formed by slitting a body of foam material in a substantially uncompressed state (1) from an outside surface of the body in a direction generally perpendicular to the rotational axis and (2) on circumferentially spaced planes that extend generally radially from the outside surface of the body to define a plurality of foam fingers. A fastening system is used to compress and hold a center portion of the foam body in a direction along the rotational axis such that the uncompressed outer ends of the finger assume a generally spherical ball.

21 Claims, 8 Drawing Sheets

BUFFING BALL MADE OF FOAM MATERIAL

CROSS-REFERENCE TO RELATED APPLICATION

This application claims priority from U.S. Provisional Patent Application Ser. No. 60/526,680, filed Dec. 3, 2003.

BACKGROUND OF THE INVENTION

The present invention pertains to a rotary buffing device adapted to be attached to and driven by a powered operating tool or the like and, more particularly, to a buffing ball made at least partly of a plastic foam piece which is slit and compressed to form a ball for buffing, polishing and finishing a painted surface.

Foam buffing pads are well known in the art and typically comprise circular, generally flat-faced pads attached to a circular backing plate which, in turn, is attached to a rotary or orbital powered operating tool. It is also known to make foam buffing pads by attaching a dense array of individual plastic foam fingers to a backing substrate such as is disclosed in U.S. Pat. No. 5,938,515. It is also known to make a buffing ball from a stack of thin circular layers of a cloth material, such as felt, that are slit radially inwardly from their outer edges and clamped axially such that the layers take on a somewhat spherical shape comprising an array of cloth fingers. The ball is mounted for rotation on the axis along which the cloth layers are pressed together to provide a generally spherical buffing ball.

Because the prior art buffing ball is made of individual thin layers of cloth that are only slightly compressible and are stacked and clamped axially along the center axis, there is a tendency for relative rubbing movement between the layers which can result in fretting and wearing of the cloth. Also, because the individual layers are inherently thin, there is also a tendency for the fingers to tear more easily from the body of the cloth layer.

SUMMARY OF THE INVENTION

In accordance with the present invention, a buffing and polishing ball is made of a compressible polymeric foam material mounted to be driven on a rotational axis, the ball comprising a body of foam material that is slit in a substantially uncompressed state from an outside surface of the body in a direction generally perpendicular to the rotational axis, and further slit on circumferentially spaced planes that extend generally radially from the outside surface to define a plurality of foam fingers, and means for compressing and holding a center portion of the slit foam body in a direction along the axis such that the uncompressed outer ends of the fingers define a generally spherical ball. The slot that extends generally perpendicular to the rotational axis is preferably a single continuous spiral cut. In a preferred embodiment of the invention, the center portion of the foam body is unslit. Further, the spiral slit and the circumferentially spaced radially extending slits define fingers that, in the generally uncompressed state and after compression of the center portion, have rectangular outer ends. Preferably, the radially extending slits are cut to two depths that vary circumferentially.

The buffing and polishing ball of the present invention also includes means for mounting the ball for rotation on its axis. The mounting means preferably comprises an integral extension of the compressing and holding means. In a presently preferred embodiment, the foam body is provided with a through bore that is coincident with the rotational axis, and the compressing and holding means comprises a two-headed fastener having heads larger than the bore, the heads of the fastener being connected together in the bore with the compressed center portion of the foam body surrounding the bore captured between the fastener heads. One fastener head comprises a driving head having a plurality of driving projections that are spaced radially outwardly of the axis of the bore and extend axially toward the other fastener head. A threaded stud is connected to one fastener head and extends along the bore toward the other fastener head. The other fastener head comprises a bearing head and has an inner face comprising a bearing plate that faces the first fastener head and a center opening for receipt of the threaded stud. A nut is threaded on the stud and is adapted to bear against an opposite outer face of the other fastener head. The foam body is also preferably provided with a plurality of axially extending bores for receipt of the driving projections. The nut comprises a threaded sleeve adapted to receive the threaded stud within a portion of the sleeve, and the arrangement further includes a threaded drive shaft that is received in a remaining portion of the sleeve.

In the preferred embodiment, the foam body has a cylinder shape with the rotational axis coinciding with the axis of the cylinder.

In an alternate embodiment, the spiral slit may be replaced by a series of slits in multiple axially spaced planes that extend generally perpendicular to the rotational axis. Both the perpendicularly extending slits and the radially extending slits extend into the foam body less than the distance to the rotational axis. Preferably, the radially extending slits extend about one-half the radius of the cylinder. The generally radially extending circumferentially spaced slits may be varied circumferentially to alternately comprise slits of different depths. In one embodiment, the depth of the radially extending, circumferentially spaced slits may vary between about 0.2 and about 0.4 times the radius.

BRIEF DESCRIPTION OF THE DRAWINGS

The drawings illustrate the best mode presently contemplated of carrying out the invention.

In the drawings.

DETAILED DESCRIPTION OF THE PREFERRED EMBODIMENT

Figure 1:
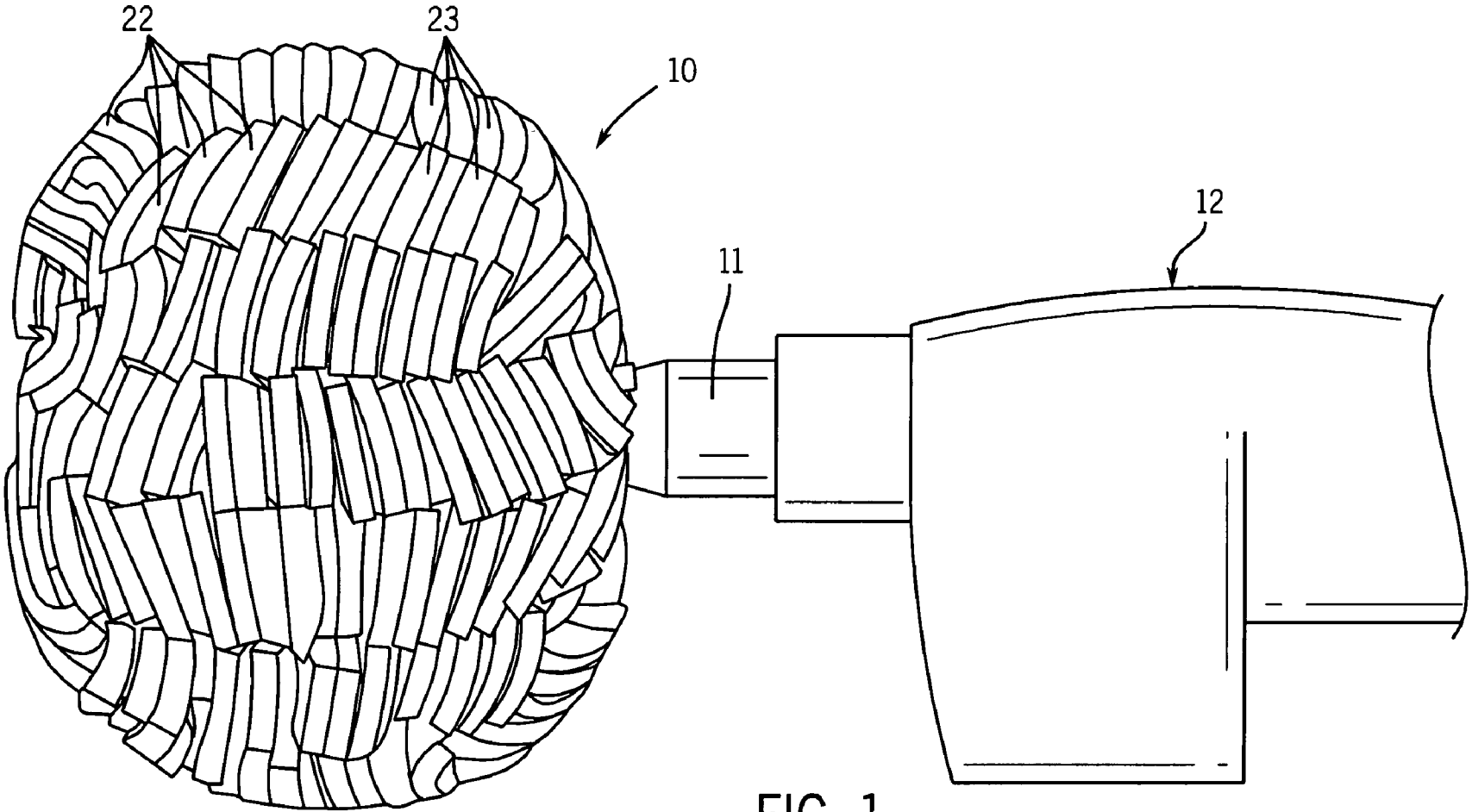
FIG. 1 is a side elevation view of the generally spherical foam buffing ball mounted on a rotary powered driving device.
Figure 3:
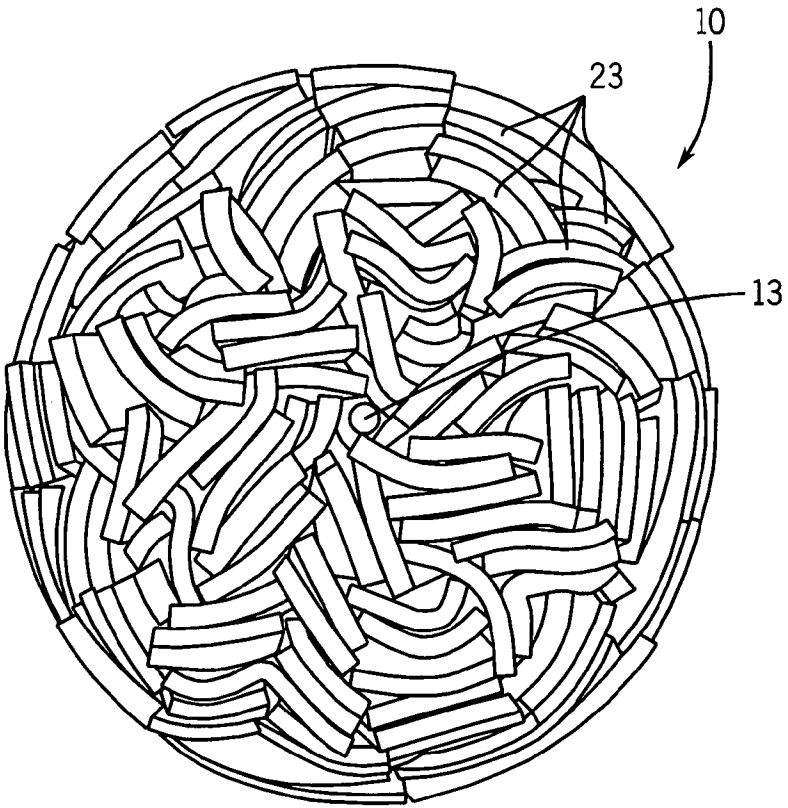
FIG. 3 is an end view of the buffing ball mounting end.
Figure 2:
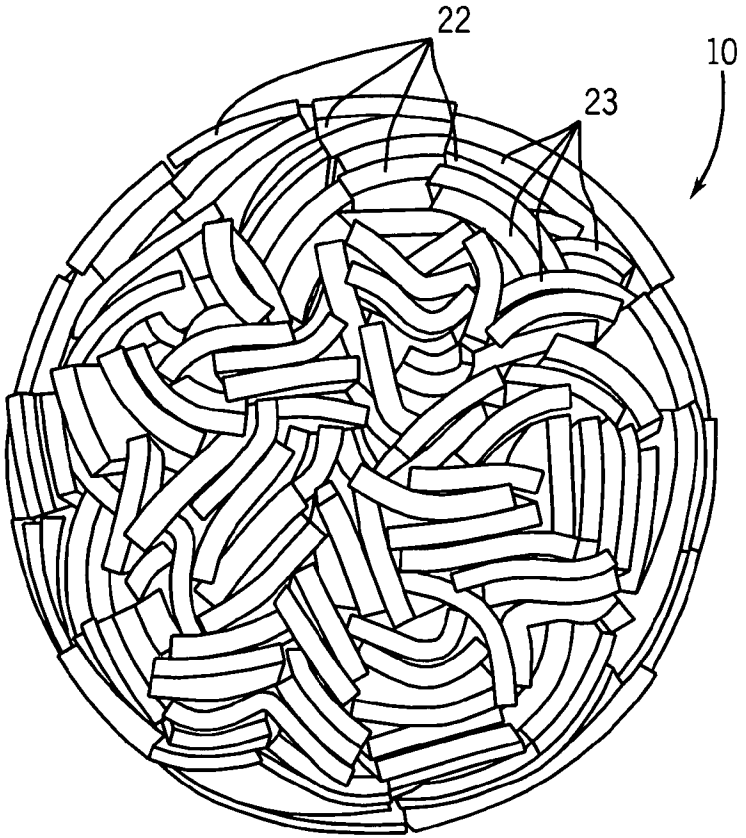
FIG. 2 is an end view of the buffing ball of FIG. 1 opposite its mounting end.

FIGS. 1–3 show a foam buffing and polishing ball 10 of the present invention. In FIG. 1, the ball is mounted on the chuck 11 of a driving tool 12 to rotate the ball about its rotational axis. In FIG. 3, the mounting end of the ball 10 is shown where a central drive shaft 13 is connected to the chuck 11 of the driving tool. The remainder of the compressing and fastening system used to shape the buffing and polishing ball 10 is contained within the interior of the ball and not normally visible.

The buffing ball 10 of the preferred embodiment of the present invention is made from a monolithic cylindrical foam body 14 which may be of an suitable polymeric foam material typically used in buffing and polishing pads for various surface finishing operations. For example, an open cell polyurethane foam which may be reticulated or unreticulated is one suitable and presently preferred material. The cylindrical foam body 14 includes a central through bore 15 on the axis of the cylindrical body. The bore 15 provides the axis for the compressing and fastening system to be described and also comprises the rotational axis of the completed ball 10.

Figure 5:
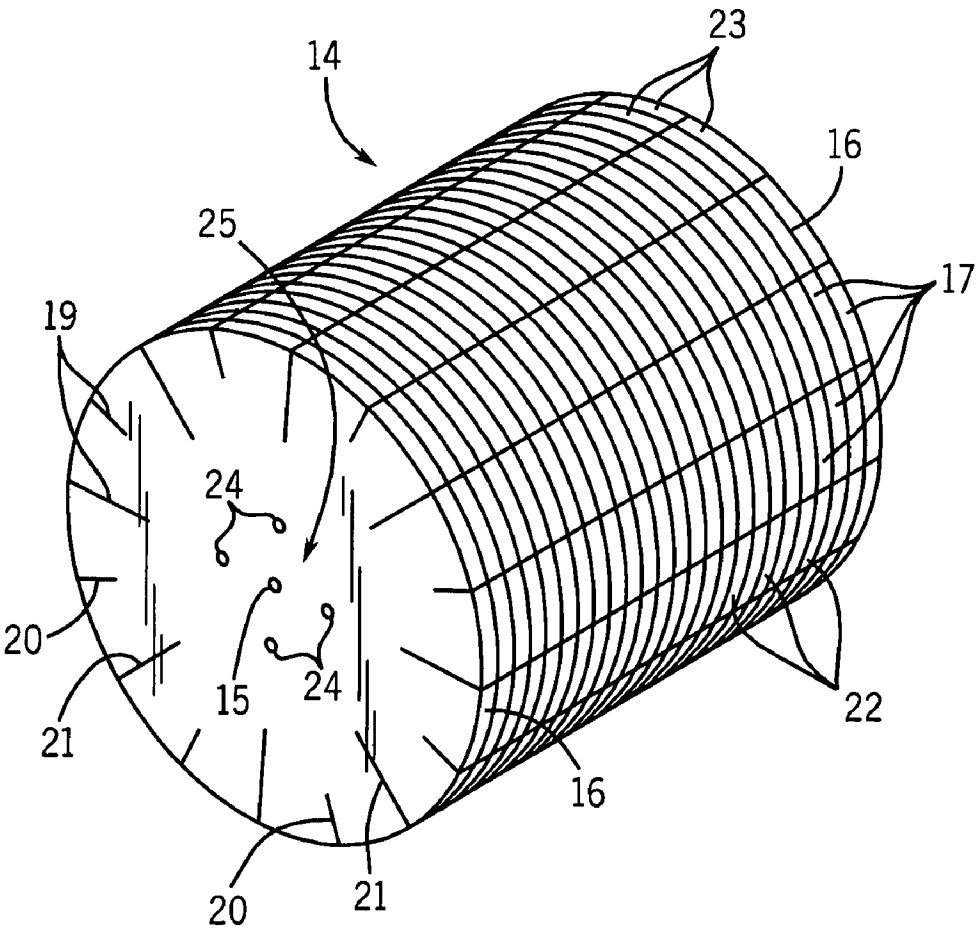
FIG. 5 is a perspective view of a cylindrical piece of polymeric foam showing generally the pattern of axially spaced parallel edge slits and circumferentially spaced radial edge slits.
Figure 6:
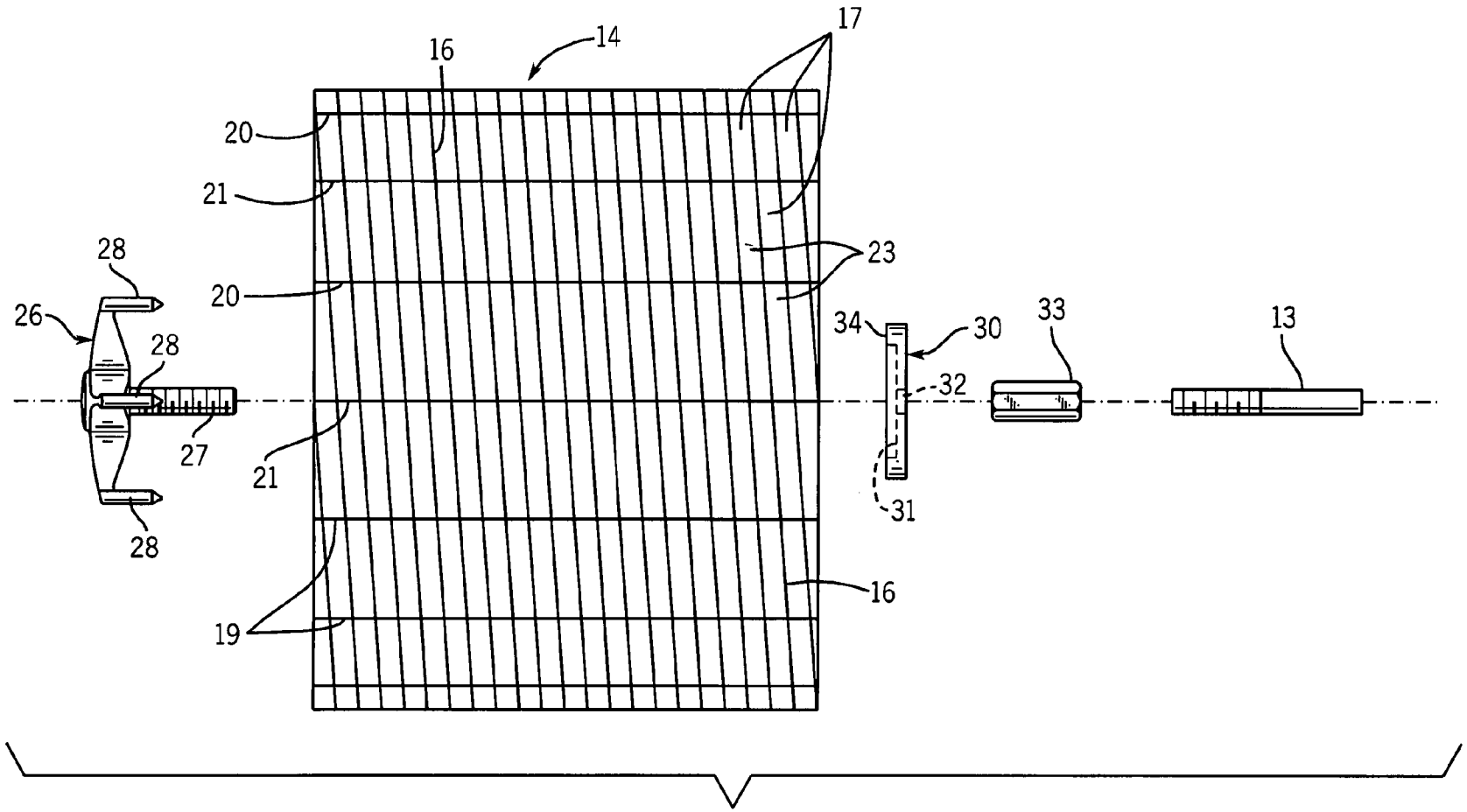
FIG. 6 is an exploded side elevation view of the cylindrical foam piece showing a slit pattern of the preferred embodiment and the compressing and fastening assembly used therewith.
Figure 9:
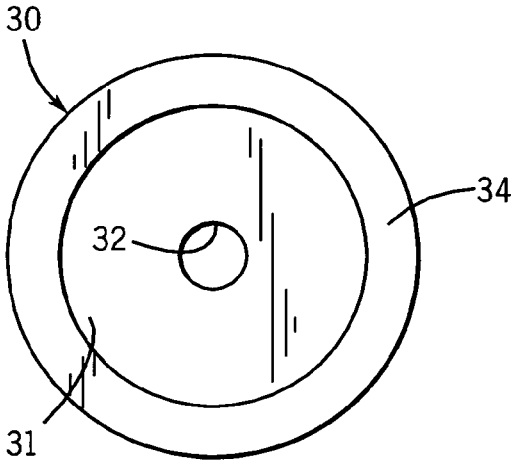
FIGS. 9–13 show the components of an alternate embodiment of the fastening system used to compress and clamp the foam piece in its final spherical shape and additionally showing a further embodiment of the drive shaft and nut for this fastening system and that of FIG. 6.
Figure 10:
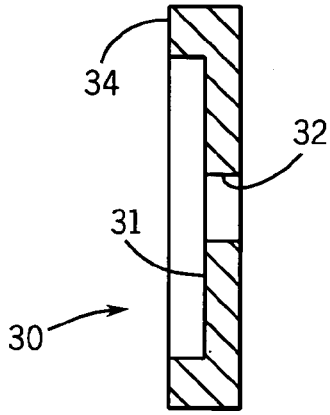

Referring particularly to FIGS. 5 and 6, the cylindrical foam body 14 is slit from an outside surface in a direction generally perpendicular to the axis of the bore 15 and is further slit from the outside surface on circumferentially spaced generally radially extending planes which include the rotational axis, and may be generally perpendicular to the first slits. Preferably, as best seen in FIG. 6, a single spiral slit 16 provides a slit that is generally perpendicular to the through bore 15 (which also coincides with the rotational axis of the polishing ball 10). The spiral slit 16 essentially provides a series of axially spaced foam layers 17. The pitch angle of the spiral slit 16 is very small such that, for example, in a cylindrical foam body 14 having an axial length of about 5 inches (about 125 mm), there may be about 25 layers 17. However, the pitch angle may be varied and, correspondingly, the number of foam layers. The spiral slit 16, in the preferred embodiment, extends to a depth of about half the radius of body 14, as shown in the slit termination line 18 in FIG. 8. However, the depth of the spiral slit 16 may be varied considerably.

Figure 8:
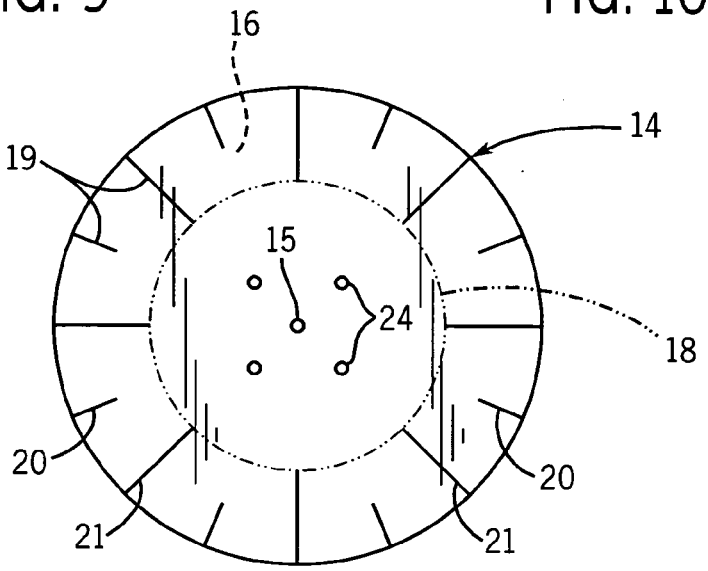
FIG. 8 is an end view of the cylindrical foam piece shown in FIG. 5.

The radial slits 19 which also extend inwardly from the outside surface of the foam body 14 preferably lie in planes that commonly intersect on the rotational axis defined by the bore 15. In the embodiment shown, there are 16 radial slits 19 which, if equally spaced, are 22.5° rotationally apart from one another. However, the number of radial slits may also vary considerably. As best seen in FIGS. 5 and 8, the radial slits 19 alternate circumferentially between shallow slits 20 and deep slits 21. With a foam body 14 having a diameter of about 6 inches (about 150 mm), the shallow slits 20 are cut to a depth of about ⅝ inch (about 16 mm) and the deep slits 21 to about the same depth as the spiral slit 16, namely, about 1.25 inches (about 30 mm). The resultant slit foam body 14 is provided with an outer cylindrical surface defined by the rectangular outer ends 23 of an array of foam fingers 22.

The spiral slit 16 is preferably made with a cutting blade brought into surface contact with the cylindrical body 14 as the body is rotated and simultaneously translated axially. The radial slits 19 (both the shallow slits 20 and the deep slits 21) are preferably made with a water jet cutter. The through bore 15 is also preferably made with the same water jet cutter, as are a series of four fastener bores 24 that are spaced radially from and surround the central through bore 15. The function of the fastener bores 24, as well as the through bore 15, will be described hereinafter.

Figure 4:
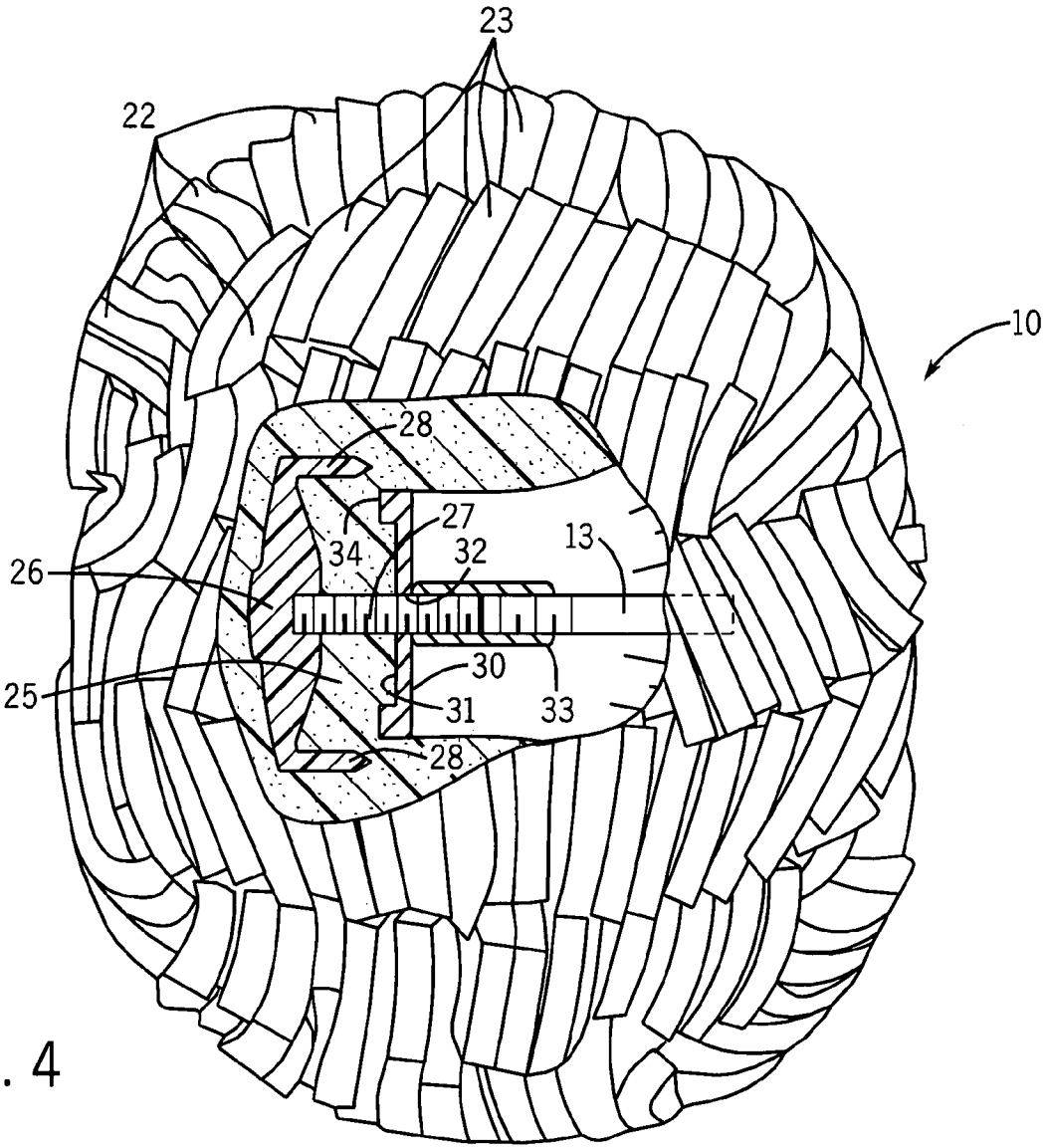
FIG. 4 is a side elevation view similar to FIG. 1 with portions shown in section to show the interaction of the components of the compressing and fastening system.
Figure 7:
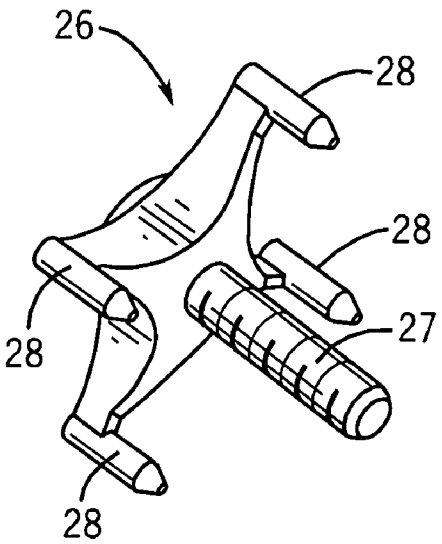
FIG. 7 is a perspective of the main driving head of the fastening system shown in FIG. 6.

Referring particularly to FIGS. 4, 6 and 7, the cylindrical foam body 14 is compressed axially and held in a manner that causes the center portion 25 of the body to be compressed and held while the foam fingers 22 are deformed in a manner such that the rectangular outer ends 23, though distorted somewhat, together assume a generally spherical shape. The fastening system includes a driving head 26 from which extend a center threaded stud 27 and a plurality of driving projections 28. The driving head 26 is pressed against one axial end of the foam body such that the threaded stud 27 enters the through bore 15 and the driving projections 28 enter the fastener bores 24. A bearing head 30 is pressed against the opposite axial end of the foam body 14 and includes an inner face comprising a bearing plate 31 and a center opening 32 which freely receives therethrough the threaded stud 27. When the driving head 26 and the bearing head 30 are pressed axially toward one another compressing the center portion 25 of the foam body therebetween, the threaded stud 27 passes through the center opening 32 in the bearing head, and an elongated nut 33 is threaded onto the stud 27 and against the back face of the bearing head 30 to hold the foam body in its compressed state and retain the spherical shape of the buffing ball 10, as best seen in FIG. 4.

The drive shaft 13 includes one threaded end that is then threaded into the opposite end of the elongated nut 33 until it bottoms on the end of the stud 27. The free unthreaded end of the drive shaft 13 is chucked into the driving tool 12, as previously described. The driving projections 28 on the driving head 26 bit into and firmly hold the compressed foam, allowing the ball 10 to be driven and held against the torque generated in a buffing and polishing operation. The inner face of the bearing head, comprising the bearing plate 31, may include a raised annular face 34 to help contain and resist radial movement of the compressed center portion 25 of the foam body 14.

Figure 11:
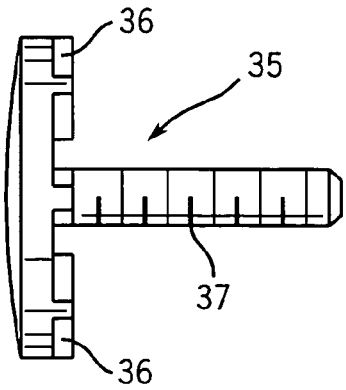
Figure 12:
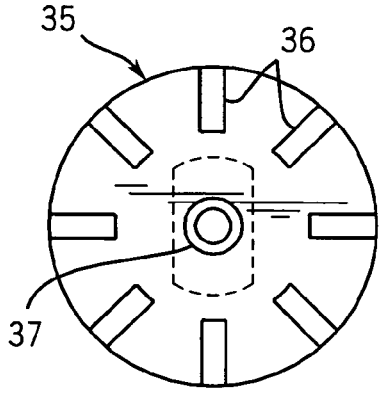
Figure 13:
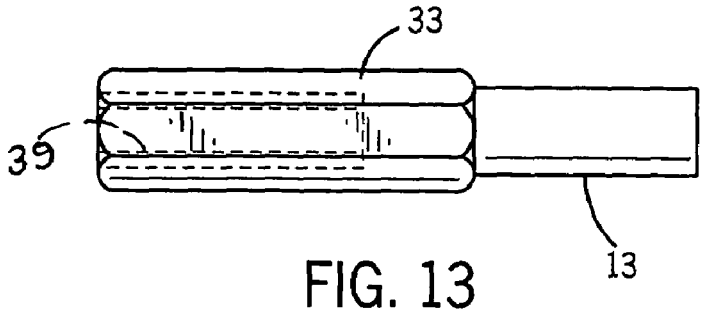

An alternate embodiment of the fastening system includes an alternate driving head 35, as shown in FIGS. 11 and 12, uses the same bearing head 30, elongated nut 33 and drive shaft 13 as described for and used in the preceding embodiment. The alternate driving head 35 includes a series of circumferentially spaced and axially extending drive lugs 36. The alternate driving head 35 also includes a center threaded stud 37 which passes through the center opening 32 in the bearing plate 31 for threaded attachment to the elongated nut 33, all in a manner similar to that previously described with respect to the preferred embodiment. In FIG. 13, an alternate embodiment of the nut includes one-piece nut and drive shaft 33 and 13. The end of the nut opposite the drive shaft has a blind bore 39 that is tapped to receive the threaded stud 27 of the driving head 26. The axially shorter drive lugs 36 of this embodiment are not believed to be as effective in holding the foam in its compressed state and transmitting the necessary drive torque to the ball 10 as are the driving projections 28 of the driving head 26 of the preferred embodiment.

Figure 14:
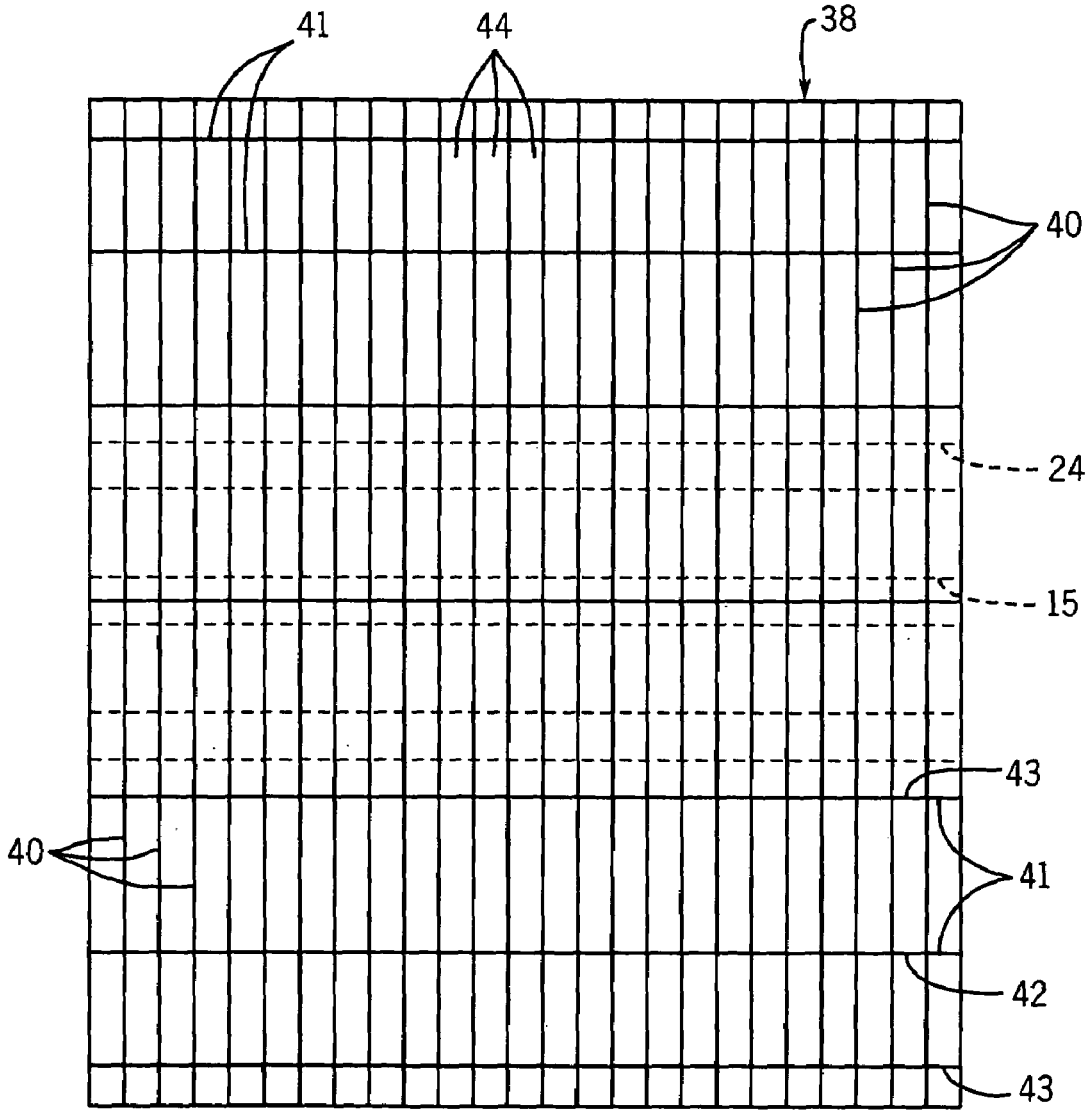
FIG. 14 is a side view of a multi-layer polymeric foam piece used in an alternate embodiment of the invention.
Figure 15:
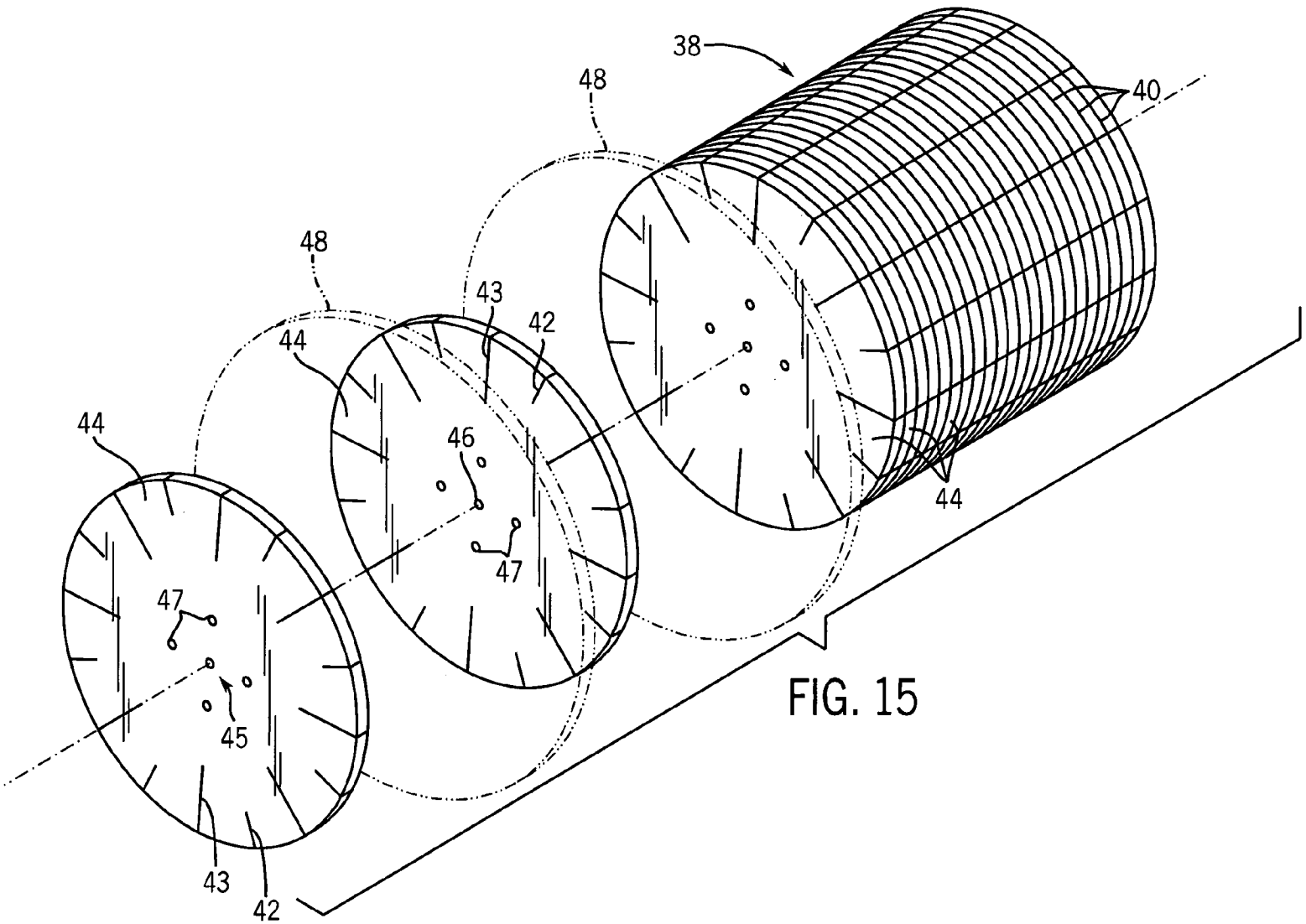
FIG. 15 is a perspective view of the multi-layer piece shown in FIG. 14.

Referring now to FIGS. 14 and 15, an alternate foam body 38 is shown. In this embodiment, separate multiple axially spaced slits 40 are utilized as opposed to a single spiral slit 16 of the preferred embodiment. The individual axially spaced slits 40 are made in planes that are truly perpendicular to the rotational axis of the cylindrical foam body 38. These slits 40 are also preferably formed with a suitable cutting tool (rotary or reciprocating), but must be made in a manner in which the tool is removed from the body and the body indexed axially with respect to the tool between slits. The alternate foam body 38 is also provided with radial slits 41 which, in a manner the same as the preferred embodiment, may alternate between shallow slits 42 and deep slits 43. The axially spaced slits 40 may also extend only a portion of the radial distance to the center of the cylindrical body, as described with respect to the previous embodiment. Also, either of the fastening systems previously described may be utilized to press and hold the foam body in its spherical operative shape.

As shown particularly in FIG. 15, the alternate foam body 38 may be made by extending the axially spaced slits 40 completely through the foam body to produce a series of individual foam layers 44. These layers may then be compressed along their center portions 45 to form the same spherical buffing ball shape and held in position with either of the previously described fastening systems. The center portion 45 may be provided with a center through bore 46 and fastener bores 47 as in the preferred embodiment. However, in this embodiment, it is preferred to use the driving head 26 of the preferred embodiment having the long driving projections 28. The driving projections 28 serve to hold the foam layers 44 together in a manner that helps prevent relative rubbing movement between the layers that is characteristic of the prior art device described above.

One advantage of utilizing an individually layered foam body as shown in FIG. 15 is that it is possible to use layers of other types of finishing material that is not compressible or only slightly compressible between foam layers 44, such that the foam layers provide the necessary compression to allow composite body to be formed into a spherical shape. In such an embodiment, as is shown in FIG. 15, the alternate finishing layers 48 may comprise non-foam material such as natural wool or non-woven synthetic materials. In this alternate embodiment, it is believed that at least about one-half the volume of the body in its uncompressed state should comprise compressible polymeric foam material. However, more or less foam material may be utilized, although the ability to form more or less truly spherical finishing ball will be reduced as the volume of foam material is reduced.

What is claimed is:

1. A buffing and polishing ball of compressible polymeric foam material mounted to be driven on a rotational axis comprising:

an uncompressed monolithic body of foam material having a slit in a substantially uncompressed state that extends from an outside surface of the body in a direction generally perpendicular and less than the distance to the rotational axis and further having slits on circumferentially spaced planes extending generally radially from said outside surface toward and less than the distance to the axis to define a plurality of foam fingers and an unslit center portion, and means for holding the center portion of said slit foam body in a compressed state along said axis such that uncompressed outer ends of said fingers define a substanially spherical ball.

2. The apparatus as set forth in claim 1 including means for mounting said ball for rotation on said axis.

3. The apparatus as set forth in claim 2 wherein said mounting means comprises an integral extension of said compressing and holding means.

4. The apparatus as set forth in claim 1 wherein said uncompressed monolithic body of foam has a cylinder shape and said rotational axis coincides with the axis of the cylinder.

5. The apparatus as set forth in claim 4 wherein said radially extending slits extend about one-half the length of the radius of the cylinder.

6. The apparatus as set forth in claim 4 wherein the slits in said circumferentially spaced planes extend a distance of between about 0.2 to about 0.4 times said radius.

7. The apparatus as set forth in claim 1 wherein the foam body has a through bore coincident with the rotational axis and said holding means comprises a two-headed fastener having heads larger than the bore, the heads of said fastener connected together in the bore with the compressed unslit center portion of the foam body surrounding the bore captured between the fastener heads.

8. The apparatus as set forth in claim 7 wherein said fastener comprises:

a driving head for one fastener head, said driving head having a plurality of driving projections spaced radially outwardly of the axis of said bore and extending axially toward the other fastener head;

a threaded stud connected to said one fastener head and extending along said bore toward the other fastener head;

a bearing head on said other fastener head, said bearing head having an inner face comprising a bearing plate facing said one fastener head and a center opening for receipt of said threaded stud; and, a nut threaded on the stud and adapted to bear against an opposite outer face of said other fastener head.

9. The apparatus as set forth in claim 8 wherein the foam body is provided with a plurality of axially extending bores for receipt of said driving projections.

10. The apparatus as set forth in claim 8 wherein said nut comprises a threaded sleeve adapted to receive said threaded stud within a portion of said sleeve.

11. The apparatus as set forth in claim 1 wherein said generally perpendicular slit comprises a single spiral slit.

12. The apparatus as set forth in claim 11 wherein the spiral slit and said circumferentially spaced radially extending slits define fingers in the substantially uncompressed state that have rectangular outer ends.

13. The apparatus as set forth in claim 12 wherein the radially extending slits are cut to two depths that vary circumferentially.

14. A method of making a buffing and polishing ball of compressible polymeric foam material, comprising the steps of:

slitting a substantially uncompressed monolithic body of foam material from an outside surface of the body in a direction generally perpendicular and less than the distance to a rotational axis and further slitting said body on circumferentially spaced planes extending generally radially from said outside surface toward and less than the distance to the axis to define a plurality of foam fingers and an unslit center portion, and compressing and holding the center portion of said slit foam body in a direction along said axis such that the uncompressed outer ends of said fingers define a substantially spherical ball.

15. The method as set forth in claim 14 including the step of mounting said ball for rotation on said axis.

16. The method as set forth in claim 14 wherein said body of foam has a cylinder shape and said rotational axis coincides with the axis of the cylinder.

17. The method as set forth in claim 14 including the step of providing the foam body with a through bore coincident with the rotational axis, and wherein said compressing and holding steps comprise compressing the foam body axially between a two-headed fastener having heads larger than the bore, and connecting the heads of said fastener together in the bore with the compressed unslit center portion of the foam body surrounding the bore captured between the fastener heads.

18. The method as set forth in claim 14 wherein said step of slitting in a direction generally perpendicular to the rotation axis comprises making a single spiral slit.

19. A buffing and polishing ball of compressible polymeric foam material mounted to be driven on a rotational axis comprising:

a body of foam material having a slit in a substantially uncompressed state that extends from an outside surface of the body in a direction generally perpendicular to the rotational axis and further having slits on circumferentially spaced planes extending generally radially from said outside surface to define a plurality of foam fingers, and means for holding a center portion of said slit foam body in a compressed state along said axis such that uncompressed outer ends of said fingers define a generally spherical shape;

the foam body having a through bore coincident with the rotational axis, and said compressing and holding means comprising a two-headed fastener having heads larger than the bore, the heads of said fastener connected together in the bore with the compressed center portion of the foam body surrounding the bore captured between the fastener heads;

a driving head for one fastener head, said driving head having a plurality of driving projections spaced radially outwardly of the axis of said bore and having ends extending axially toward the other fastener head;

a threaded stud connected to said one fastener head and extending along said bore toward the other fastener head;

a bearing head on said other fastener head, said bearing head having an inner face comprising a bearing plate facing said one fastener head and a center opening for slidable receipt of said threaded stud; and, a nut threaded on the stud and adapted to bear against an opposite outer face of said other fastener head and to draw the driving head and driving projections to and, without contacting said bearing plate, whereby the ends of the driving projections extend through the compressed center portion and the compression of the compressed center portion of the foam body can be adjusted wherein the driving projections are positioned to define a circle centered on said axis, said circle having a diameter greater than the diameter of the bearing head.

20. The apparatus as set forth in claim 19 wherein the foam body is provided with a plurality of axially extending bores for receipt of said driving projections.

21. The apparatus as set forth in claim 19 wherein the foam body is monolithic and said center portion is unslit.

* * * * *